US012319527B2

(12) United States Patent
Noda et al.

(10) Patent No.: US 12,319,527 B2
(45) Date of Patent: Jun. 3, 2025

(54) FEED MECHANISM, IMAGE FORMING APPARATUS, AND FEED TRAY

(71) Applicant: Brother Kogyo Kabushiki Kaisha, Nagoya (JP)

(72) Inventors: Kengo Noda, Inazawa (JP); Gakuro Kanazawa, Toyokawa (JP); Satoshi Miyase, Nagoya (JP); Yuki Tsujimura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 153 days.

(21) Appl. No.: 17/563,486

(22) Filed: Dec. 28, 2021

(65) Prior Publication Data

US 2022/0204297 A1 Jun. 30, 2022

(30) Foreign Application Priority Data

Dec. 29, 2020 (JP) ..... 2020-219745

(51) Int. Cl.
*B65H 23/032* (2006.01)
*B65H 1/26* (2006.01)

(52) U.S. Cl.
CPC ..... *B65H 23/0322* (2013.01); *B65H 1/266* (2013.01); *B65H 2301/415085* (2013.01); *B65H 2801/03* (2013.01)

(58) Field of Classification Search
CPC .... B65H 23/02; B65H 23/0322; B65H 1/266; B65H 2301/23; B65H 2301/4315; B65H 2301/4318
See application file for complete search history.

(56) References Cited

U.S. PATENT DOCUMENTS 5,072,306 A * 12/1991 Matsumoto ..... H04N 1/00567 399/385
5,386,283 A * 1/1995 Yang ..... G03G 15/6517 399/385
10,858,206 B2 * 12/2020 Yoshii ..... B65H 1/266
11,137,710 B2 * 10/2021 Kanzawa ..... G03G 15/6511
11,648,787 B2 * 5/2023 Hashizume ..... B65H 1/04 271/146
11,713,203 B2 * 8/2023 Nakamura ..... B65H 1/12 271/8.1

FOREIGN PATENT DOCUMENTS

JP H02-264556 A 10/1990
JP H03-049236 U 5/1991
JP 2013-000973 A 1/2013

OTHER PUBLICATIONS

Nov. 19, 2024—(JP) Office Action—JP App 2020-219745, Eng Tran.
Aug. 27, 2024—(JP) Notice of Reasons for Refusal—JP App 2020-219745, Eng Tran.

* cited by examiner

*Primary Examiner* — Patrick Cicchino
(74) *Attorney, Agent, or Firm* — Banner & Witcoff, Ltd.

(57) ABSTRACT

A feed mechanism includes: a feed tray accommodating a roll body, a first sheet-shaped medium being rolled in a roll shape as the roll body, the feed tray including: a first accommodation portion accommodating the roll body; a pair of side walls respectively provided on both sides of the first accommodation portion in an axial direction of the roll body that is accommodated in the first accommodation portion; and a side guide disposed inside the pair of side walls.

11 Claims, 10 Drawing Sheets

FEED MECHANISM, IMAGE FORMING APPARATUS, AND FEED TRAY

CROSS-REFERENCE TO RELATED APPLICATIONS

This application is based on and claims priority under 35 USC 119 from Japanese Patent Application No. 2020-219745 filed on Dec. 29, 2020, the contents of which are incorporated herein by reference.

TECHNICAL FIELD

The present disclosure relates to a feed mechanism including a feed tray that is configured to accommodate a roll body around which a long sheet-shaped medium is rolled in a roll shape and is configured to be inserted into and removed from a housing of an image forming apparatus, the image forming apparatus, and the feed tray.

BACKGROUND

A related-art facsimile (an image forming apparatus) includes a paper feed cassette (a feed tray) that is attachable to and detachable from a facsimile main body. The paper feed cassette includes a support portion for roll paper (a roll medium) and accommodates the roll paper.

SUMMARY

A feed mechanism according to the present disclosure includes: a feed tray configured to accommodate a roll body, a first sheet-shaped medium being rolled in a roll shape as the roll body. The feed tray may include: a first accommodation portion configured to accommodate the roll body; a pair of side walls respectively provided on both sides of the first accommodation portion in an axial direction of the roll body that is accommodated in the first accommodation portion; and a side guide disposed inside the pair of side walls.

An image forming apparatus according to the present disclosure includes a housing and the above-described feed mechanism including the feed tray being insertable into and removable from the housing.

A feed tray according to the present disclosure is configured to accommodate a roll body, a first sheet-shaped medium being rolled in a roll shape as the roll body. The feed tray may include: a first accommodation portion configured to accommodate the roll body; a pair of side walls respectively provided on both sides of the first accommodation portion in an axial direction of the roll body that is accommodated in the first accommodation portion; and a side guide disposed inside the pair of side walls.

According to a feed mechanism, an image forming apparatus, and a feed tray of the present disclosure, a position of at least one of a roll body or a roll medium in an axial direction is determined by a side guide that is provided to the feed tray accommodating the roll body. Therefore, it is possible to prevent position deviation of at least one of the roll body and the roll medium in the axial direction.

BRIEF DESCRIPTION OF DRAWINGS

Illustrative embodiments of the disclosure will be described in detail based on the following figures, wherein:

FIG. 7A is a diagram illustrating a state in which the side guide is in a non-overlapping position, and FIG. 7B is a diagram illustrating a state in which the side guide is in an overlapping position;

DETAILED DESCRIPTION

In the above-described related-art, when a roll body, around which a long sheet-shaped medium is rolled in a roll shape, positionally deviates in a paper feed cassette, and when the roll medium unrolled from the roll body and conveyed in the paper feed cassette positionally deviates in a width direction (an axial direction of the roll body), a jam may occur.

Therefore, illustrative aspects of the present disclosure provide a feed mechanism, an image forming apparatus, and a feed tray that prevent position deviation of at least one of a roll body or a roll medium in an axial direction.

Figure 1:
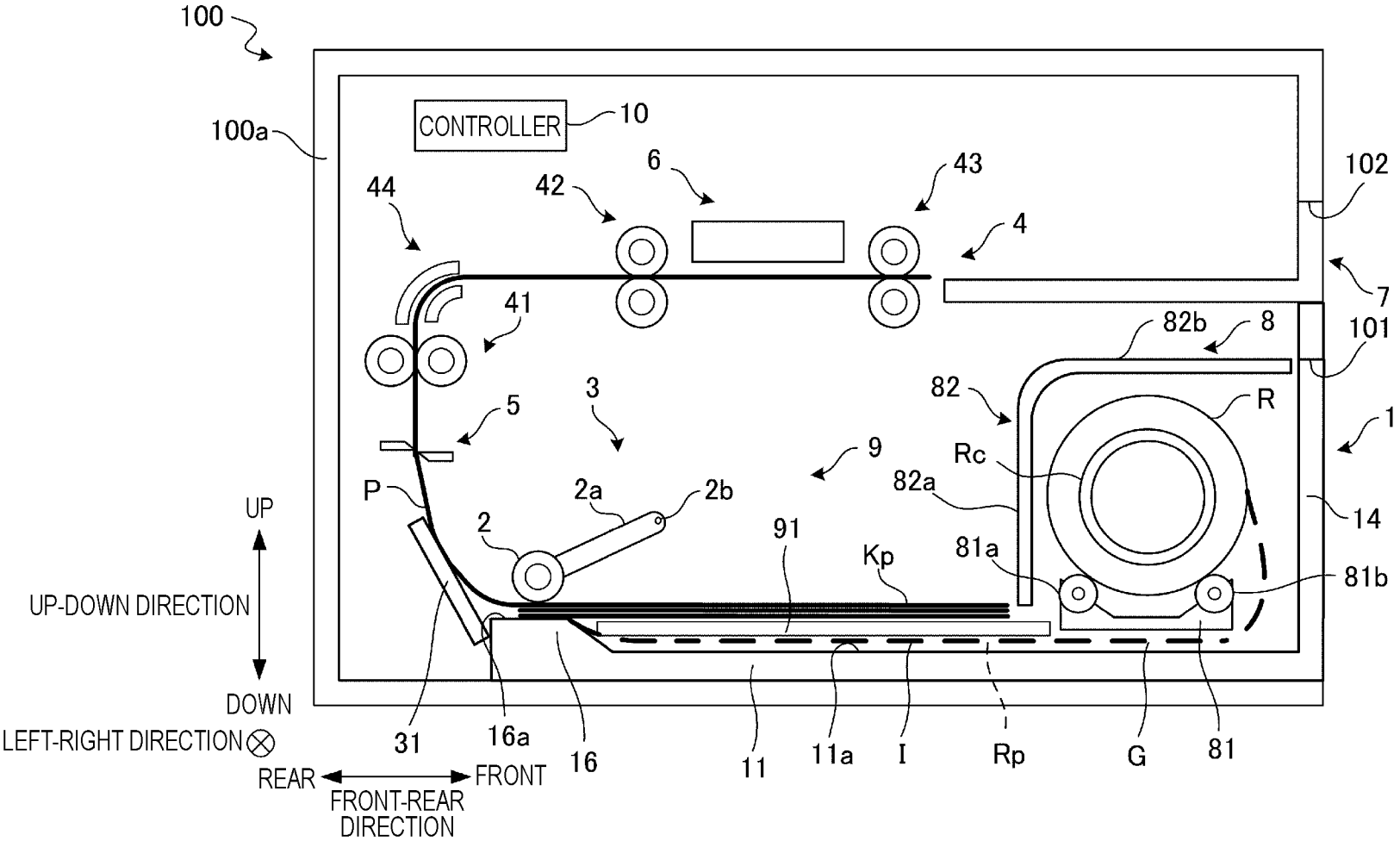
FIG. 1 is a schematic side view illustrating an internal structure of a printer according to an illustrative embodiment of the present disclosure.

A printer 100 (an image forming apparatus of the present disclosure) according to an illustrative embodiment of the present disclosure will be described below with reference to FIG. 1. An up and down direction, a front and rear direction, and a left and right direction illustrated in FIG. 1 are defined as an up and down direction, a front and rear direction, and a left and right direction of the printer 100.

Overall Configuration of Printer 100

The printer 100 mainly includes a housing 100*a*, a feed mechanism 3, a conveyance mechanism 4, a cutter 5, a head 6, a paper discharge tray 7, and a controller 10. The feed mechanism 3 includes a feed tray 1, a feed roller 2, and a separation piece 31. The feed tray 1 is detachable to a lower part of the housing 100*a*. The feed tray 1 is disposed below the head 6 in the housing 100*a*. The paper discharge tray 7 is disposed in in front of the head 6 in the housing 100*a* and above the feed tray 1. The feed tray 1 is insertable and removable into and from the housing 100*a* along the front and rear direction through an opening 101 formed in a front wall of the housing 100*a*. The paper discharge tray 7 is insertable and removable into and from the housing 100*a* along the front and rear direction through an opening 102 formed in the front wall of the housing 100*a*.

The feed tray 1 may accommodate both the cut paper Kp and roll body R. The feed tray 1 includes a first accommodation portion 8 and a second accommodation portion 9. The first accommodation portion 8 may accommodate the roll body R. The second accommodation portion 9 may accommodate a plurality of sheets of cut paper Kp stacked in the up and down direction. The roll body R may be formed by rolling long paper in a roll shape around an outer peripheral surface of a cylindrical core member Rc. A width direction of the cut paper Kp and the roll paper Rp unrolled from the roll body R in the feed tray 1 coincides with the left and right direction. The cut paper Kp is shorter than the long paper rolled therearound in the roll shape.

The feed roller 2 feeds the roll paper Rp unrolled from the roll body R accommodated in the first accommodation portion 8 or the cut paper Kp accommodated in the second accommodation portion 9 from the feed tray 1. In the following description, when the cut paper Kp and the roll paper Rp are not distinguished, the cut paper Kp and the roll paper Rp are referred to as "paper P". The feed roller 2 is pivotally supported at a tip of an arm 2*a* and rotates by driving a feeding motor which is not illustrated. The arm 2*a* is rotatably supported in a support shaft 2*b*. The arm 2*a* is urged by an urging member which is not illustrated so that the feed roller 2 approaches a bottom surface 11*a* of the feed tray 1. When the feeding motor is driven by the control of the controller 10, the feed roller 2 rotates to apply a conveying force in a direction directed from the front to the rear with respect to the paper P in contact with the feed roller 2. As a result, the paper P is fed from the feed tray 1. The arm 2*a* is configured to be retractable upward when the feed tray 1 is attached to or detached from the housing 100*a*.

The separation piece 31 is provided for preventing overlapping feeding when the cut paper Kp is fed from the feed tray 1. The separation piece 31 is located on a downstream side of the feed tray 1, with respect to a conveyance direction of the paper P by the feed roller 2 (a direction from the front to the rear: simply referred to as "a conveyance direction" in the following description). The separation piece 31 is inclined such that a rear end portion thereof is located above a front end portion thereof. A fine uneven pattern is formed on a surface of the separation piece 31. The separation piece 31 contacts a central portion of the cut paper Kp in the width direction and separates the cut paper Kp that contacts the feed roller 2 from the rest of cut paper Kp. The paper P fed from the feed tray 1 and contacting the separation piece 31 is guided diagonally upward.

The conveyance mechanism 4 includes a pair of intermediate rollers 41, a pair of conveying rollers 42, a pair of paper discharging rollers 43, and a guide member 44. The pair of intermediate rollers 41 is formed of a drive roller that rotates by driving an intermediate motor which is not illustrated and a driven roller that rotates in association with the rotation of the drive roller. When the intermediate motor which is not illustrated is driven by the control of the controller 10, the pair of intermediate rollers 41 rotates while sandwiching the paper P to convey the paper P. The pair of intermediate rollers 41 is located above the separation piece 31. The pair of intermediate rollers 41 conveys the paper P upward, which is fed from the feed tray 1 by the feed roller 2 and then guided diagonally upward by the separation piece 31, while sandwiching the paper P. The guide member 44 is located above the pair of intermediate rollers 41. The guide member 44 guides the paper P to be conveyed upward by the pair of intermediate rollers 41 forward.

The pair of conveying rollers 42 is formed of a drive roller that rotates by driving a conveying motor which is not illustrated and a driven roller that rotates in association with the rotation of the drive roller. The pair of paper discharging rollers 43 is formed of a drive roller that rotates by driving a paper discharging motor which is not illustrated and a driven roller that rotates in association with the rotation of the drive roller. When the conveying motor and the paper discharging motor which are not illustrated are driven by the control of the controller 10, the pair of conveying rollers 42 and the pair of paper discharging rollers 43 rotate while sandwiching the paper P to convey the paper P. The pair of conveying rollers 42 is located behind the head 6, and the pair of paper discharging rollers 43 is located in front of the head 6. The pair of conveying rollers 42 conveys the paper P to be guided forward by the guide member 44 forward while sandwiching the paper P. The pair of paper discharging rollers 43 conveys the paper P to be conveyed forward by the pair of conveying rollers 42 forward while sandwiching the paper P.

The cutter 5 is located between the separation piece 31 and the pair of intermediate rollers 41. The cutter 5 is formed of, for example, a disk-shaped rotary blade and a driven blade. The rotary blade of the cutter 5 rotates by driving a cutting motor which is not illustrated, and reciprocates along the left and right direction. The roll paper Rp unrolled from the roll body R and conveyed is cut in the width direction of the roll paper Rp by the cutter 5 by driving the cutting motor under the control of the controller 10.

The head 6 includes a plurality of nozzles (not illustrated) formed on a lower surface thereof and a driver IC (not illustrated). When the driver IC is driven by the control of the controller 10, ink is ejected from the nozzle, and the paper P conveyed by the conveyance mechanism 4 passes through an image forming position facing the lower surface of the head 6, an image is formed on the paper P. The head 6 may be either a line type that ejects ink from a nozzle in a state where a position thereof is fixed, or a serial type that ejects ink from a nozzle while moving in the left and right direction. The paper P on which the image is formed by the head 6 is received by the paper discharge tray 7.

The controller 10 is connected to the feeding motor, the intermediate motor, the conveying motor, the paper discharging motor, the cutting motor, and the driver IC via an internal bus (not illustrated). The controller 10 includes a central processing unit (CPU), a read only memory (ROM), and a random access memory (RAM). The ROM stores a program and data for allowing the CPU to perform various controls. The RAM temporarily stores data to be used by the CPU when executing the program.

Configuration of Feed Tray 1

Next, a configuration of the feed tray 1 will be described with reference to FIGS. 2 to 8. In the following description, a direction of each portion of the feed tray 1 will be described based on a posture of the feed tray 1 in a state of being mounted on the housing 100*a*. The feed tray 1 has an approximately square shape when viewed from the top. The feed tray 1 includes a bottom wall 11 and side walls 12 to 15 provided on edges of the bottom wall 11, and is formed in a box shape opened upward.

Figure 3:
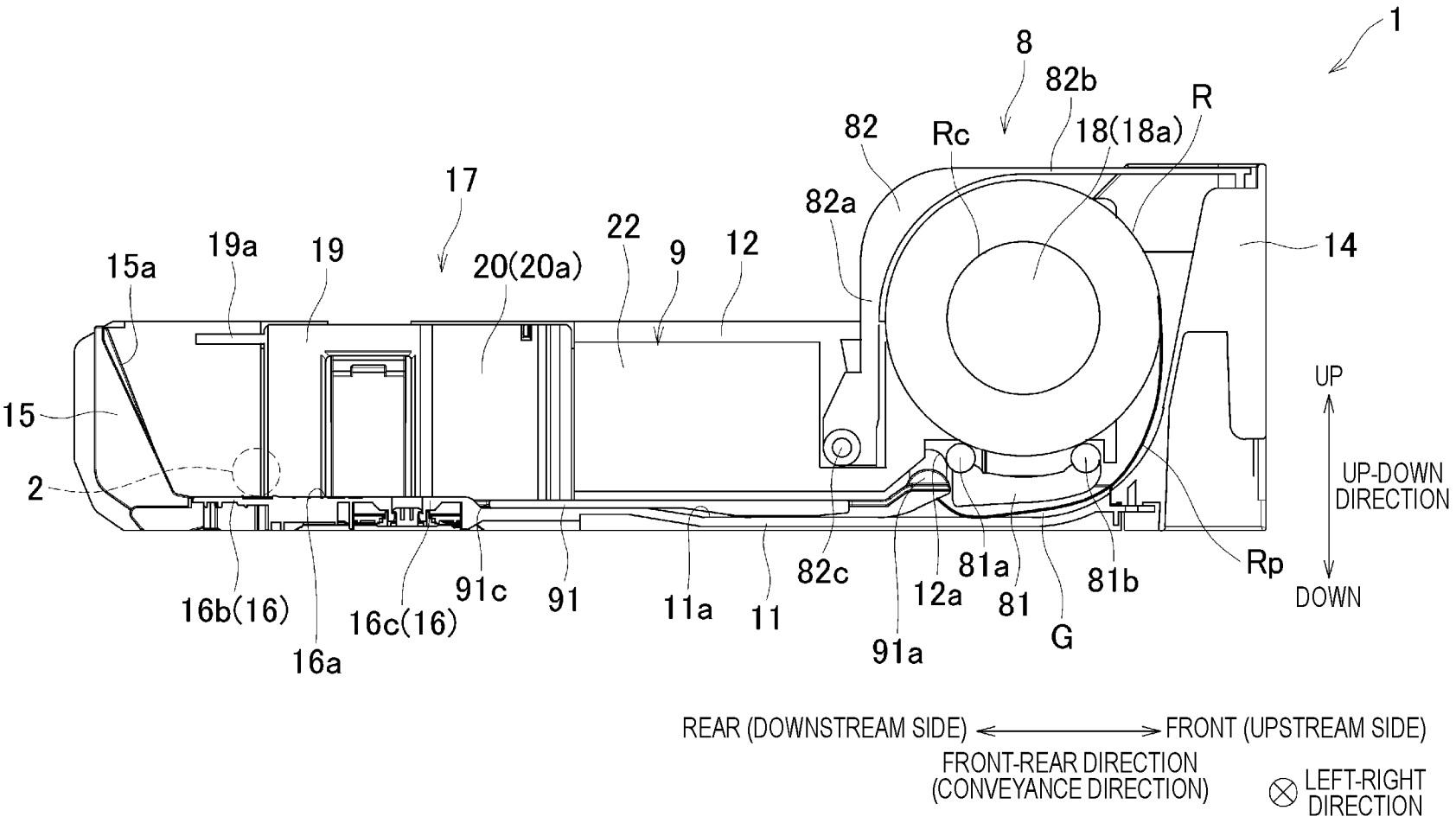
FIG. 3 is a cross-sectional view taken along a line of the feed tray illustrated in FIG. 2.
Figure 5:
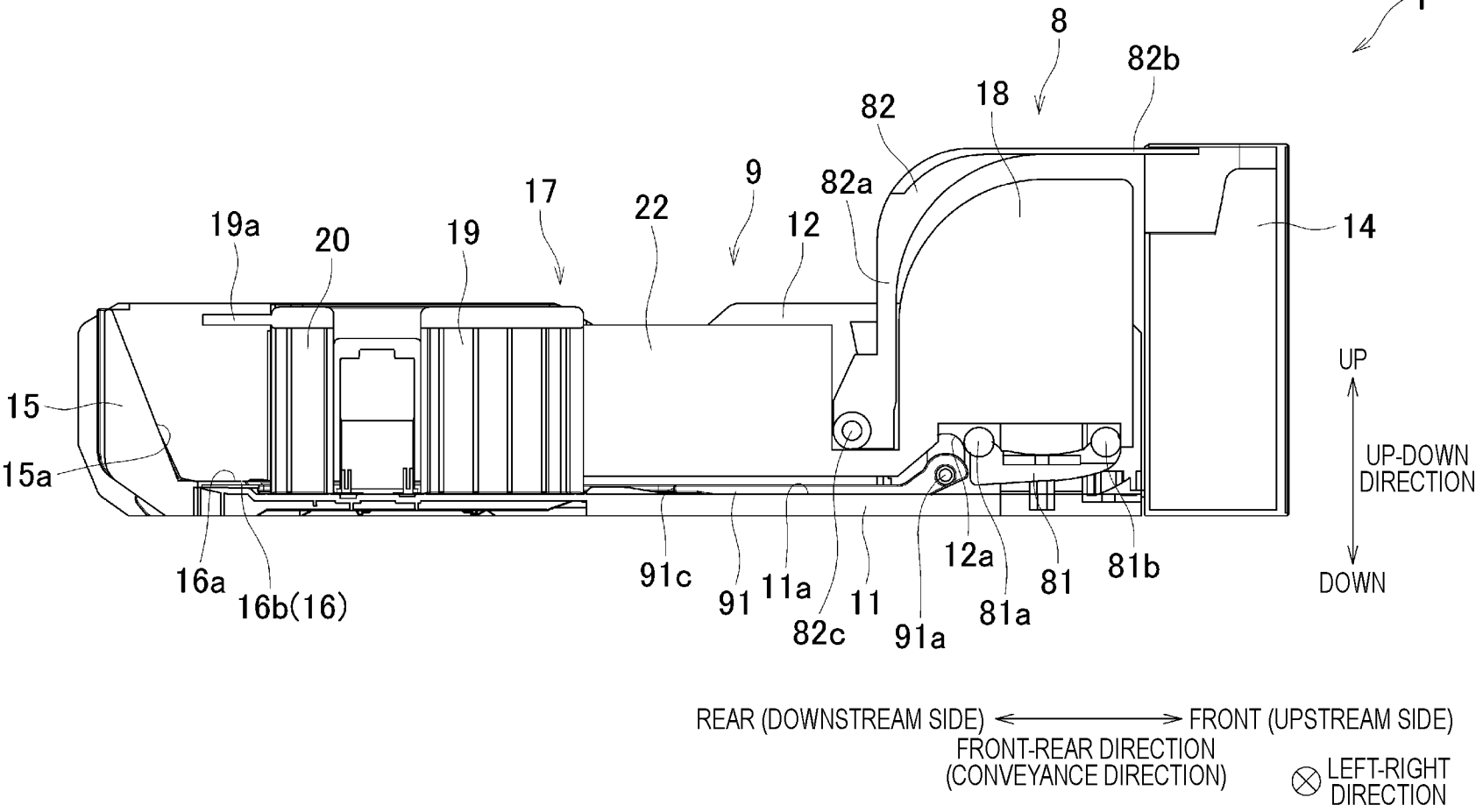
FIG. 5 is a side view of the feed tray illustrated in FIG. 2 in a state where a side wall thereof is removed.

As illustrated in FIGS. 3 and 5, the bottom wall 11 extends in a plane orthogonal to the up and down direction. An upper surface of the bottom wall 11 becomes the bottom surface 11*a* of the feed tray 1. The side walls 12 and 13 extend upward from both left and right end edges of the bottom wall 11. The side walls 12 and 13 extend from a front end portion to a rear end portion of the bottom wall 11 along the front and rear direction. The side wall 14 extends upward from a front end edge of the bottom wall 11. The side wall 14 extends from a right end portion to a left end portion of the bottom wall 11 along the left and right direction.

Figure 4:
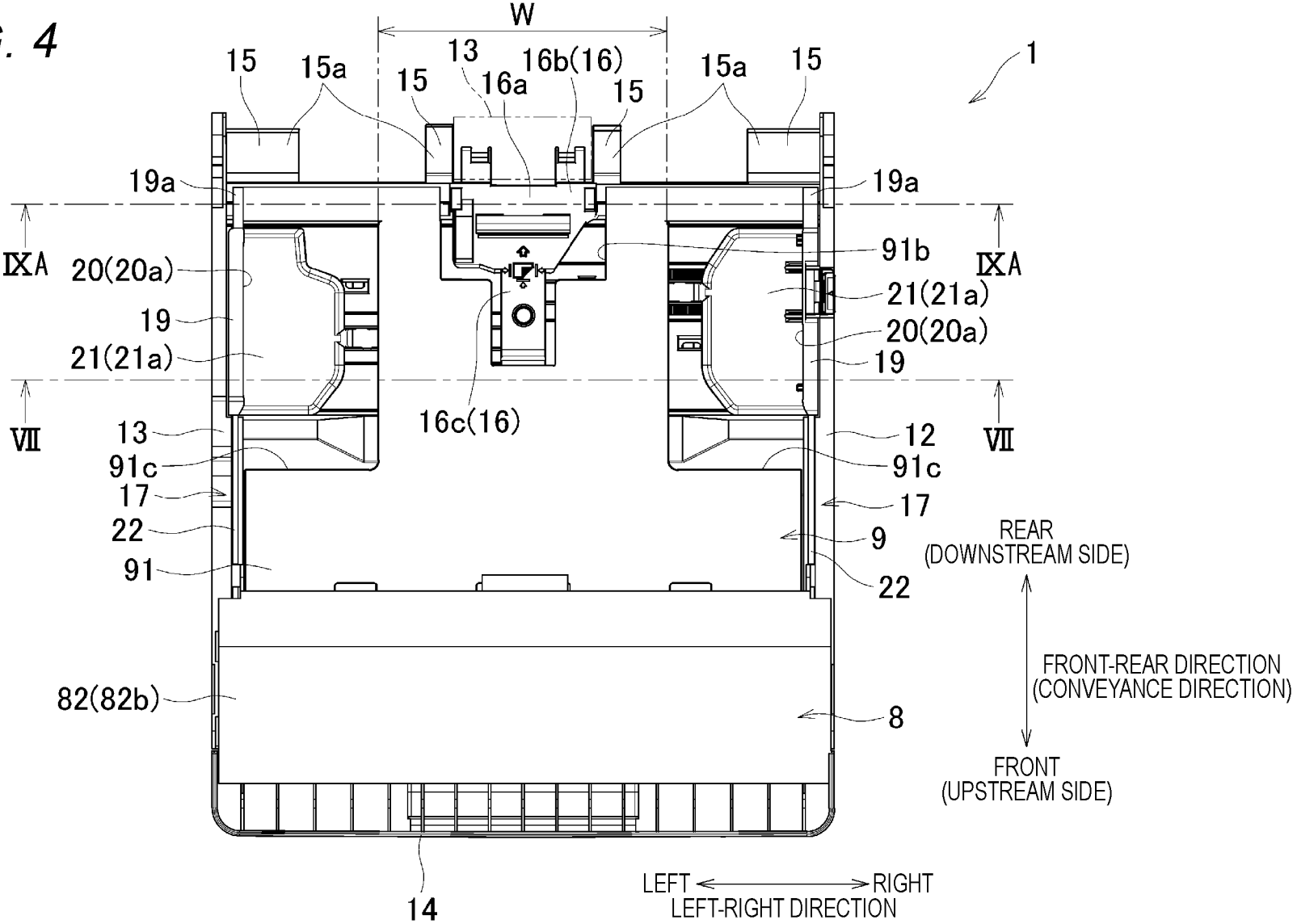
FIG. 4 is a top view of the feed tray illustrated in FIG. 2.

Four side walls 15 are provided on a rear end edge of the bottom wall 11. The side wall 15 includes a guide surface 15*a* that is connected to the rear end portion of the bottom surface 11*a* and is inclined so that an upper end portion of the guide surface 15*a* is located behind a lower end portion thereof. The four side walls 15 are separated from each other in the left and right direction. As illustrated in FIG. 4, when the feed tray 1 is mounted on the housing 100*a*, the separation piece 31 is located between the two side walls 15 located inside among the four side walls 15 disposed side by side in the left and right direction. The guide surface 15*a* of the side wall 15 guides the paper P, which is conveyed rearward by the feed roller 2, diagonally upward together with the separation piece 31.

A convex portion 16 protruding upward is formed at a central portion of the rear end portion of the bottom wall 11 in the left and right direction. An upper surface 16*a* of the convex portion 16 becomes a horizontal surface. The convex portion 16 includes a base portion 16*b* and an extending portion 16*c* of which length in the left and right direction is shorter than that of the base portion 16*b*. The extending portion 16*c* is located on an upstream side of the base portion 16*b* in the conveyance direction, and extends from a central portion of the base portion 16*b* in the left and right direction toward the upstream side in the conveyance direction.

When no paper P is provided on the upper surface 16*a* of the convex portion 16, as illustrated in FIG. 3, the feed roller 2 contacts the upper surface 16*a* of the base portion 16*b* of the convex portion 16. When the paper P is provided on the upper surface 16*a* of the convex portion 16, the feed roller 2 contacts the paper P. That is, a position where the base portion 16*b* is provided on the convex portion 16 in the conveyance direction becomes a conveying position where the feed roller 2 applies the conveying force to the paper P.

In the feed tray 1, as described above, the first accommodation portion 8 accommodating the roll body R and the second accommodation portion 9 accommodating a plurality of sheets of cut paper Kp stacked in the up and down direction are provided. The first accommodation portion 8 and the second accommodation portion 9 are disposed side by side along the conveyance direction. The second accommodation portion 9 is located on a downstream side of the first accommodation portion 8 in the conveyance direction.

The first accommodation portion 8 accommodates the roll body R in a posture in which axial directions thereof coincide with each other in the left and right direction. As illustrated in FIG. 3, the first accommodation portion 8 includes a support base 81 and two rollers 81*a* and 81*b* that support the roll body R. The support base 81 extends along the left and right direction. Both the rollers 81*a* and 81*b* extend in the left and right direction and are disposed to be separated from each other in the front and rear direction. Both the rollers 81*a* and 81*b* are supported by an upper end portion of the support base 81 to be rotatable around a rotating shaft extending along the left and right direction. The rollers 81*a* and 81*b* support the roll body R from below in a state of contacting an outer peripheral surface of a lower portion of the roll body R.

A gap G is formed between a lower surface of the support base 81 and the bottom surface 11*a* of the feed tray 1. As will be described later, when the roll paper Rp is set in the feed tray 1, the roll body R supported by the support base 81 rotates clockwise in FIG. 3, and the roll paper Rp is pulled out from a front side portion of the roll body R. Next, the roll paper Rp pulled out from the roll body R is pulled out from a front side of the support base 81 to a rear side of the support base 81 through the gap G.

As illustrated in FIG. 3, the first accommodation portion 8 includes a cover 82 formed of a rear portion 82*a* that covers a rear side of the roll body R supported by the support base 81 and an upper portion 82*b* that covers an upper side of the roll body R supported by the support base 81. The rear portion 82*a* is located behind the roll body R supported by the support base 81, and extends in a plane orthogonal to the front and rear direction. The upper portion 82*b* is connected to an upper end portion of the rear portion 82*a*. The upper portion 82*b* is located above the roll body R supported by the support base 81, and extends in a plane orthogonal to the up and down direction. The cover 82 is rotatable rearward around a rotating shaft 82*c* located at a lower end portion of the rear portion 82*a* and extending in the left and right direction. As illustrated in FIG. 3, the cover 82 located at a position of covering the roll body R supported by the support base 81 rotates to the rear side, such that an accommodation space of the roll body R above the support base 81 is exposed.

The second accommodation portion 9 accommodates the cut paper Kp in a posture in which axial directions thereof coincide with each other in the left and right direction. The second accommodation portion 9 includes a support plate 91 (corresponding to a "support member" of the present disclosure) that supports a plurality of sheets of cut paper Kp placed in a stacked state from below. When the roll paper Rp unrolled from the roll body R accommodated in the first accommodation portion 8 is fed from the feed tray 1 to form an image, the cut paper Kp is removed from the second accommodation portion 9.

The support plate 91 is located at an end portion of the front side. The support plate 91 is rotatable up and down around a rotating shaft 91*a* extending along the left and right direction. Here, as illustrated in FIG. 3, an opening 12*a* having an elliptical shape elongated in the up and down direction is formed on the side wall 12 of the feed tray 1. One end portion (a right end portion) of the rotating shaft 91*a* of the support plate 91 is inserted into the opening 12*a* of the side wall 12. In the same manner, the side wall 13 is formed with an opening (not illustrated) having an elliptical shape elongated in the up and down direction. The other end portion (a left end portion) of the rotating shaft 91*a* of the support plate 91 is inserted into the opening. The rotating shaft 91*a* is movable up and down within the opening 12*a* of the side wall 12 and the opening (not illustrated) of the side wall 13.

The rotating shaft 91*a* is located between the support base 81 and the rear portion 82*a* of the cover 82 in the conveyance direction. The support plate 91 extends, toward the downstream side in the conveyance direction, from the rotating shaft 91*a* to a position of an end portion on a downstream side of the bottom wall 11 of the feed tray 1 in the conveyance direction.

The support plate 91 functions as a partitioning material that vertically partitions the cut paper Kp accommodated in the second accommodation portion 9 and the roll paper Rp unrolled from the roll body R. The roll paper Rp unrolled from the roll body R passes between the bottom wall 11 of the feed tray 1 and the support plate 91. That is, the bottom wall 11 of the feed tray 1 and the support plate 91 define an introduction path for guiding the roll paper Rp unrolled from the roll body R accommodated in the first accommodation portion 8.

The feed tray 1 is disposed inside a pair of side walls 12 and 13 respectively provided on both sides of the first accommodation portion 8 in the left and right direction, and includes a pair of side guides 17 separated from each other in the left and right direction. The side guides 17 are supported by the bottom wall 11 to be movable in the left and right direction, and are disposed to face each other in the left and right direction. A first side guide 17, which is the side guide 17 provided on one side, and a second side guide 17, which is the side guide 17 provided on the other side, are configured to be interlocked and are movable in a direction in which the side guides 17 are separated from each other by, for example, a known interlocking mechanism (not illustrated) formed of racks facing each other and pinions that mesh with both racks.

As illustrated in FIG. 5, the pair of side guides 17 respectively extends from a portion corresponding to the first accommodation portion 8 to a portion corresponding to the second accommodation portion 9 along the conveyance direction. A portion of the side guide 17 located at the first accommodation portion 8 is a first side guide 18 that guides the roll body R accommodated in the first accommodation portion 8. A portion of the side guide 17 located on a downstream side of the second accommodation portion 9 in the conveyance direction is a second side guide 19 that guides the cut paper Kp accommodated in the second accommodation portion 9 and the roll paper Rp unrolled from the roll body R. The first side guide 18 and the second side guide 19 are connected to each other by a connecting portion 22.

The first side guide 18 has a plate shape parallel to the side walls 12 and 13. The first side guide 18 is located in an inner space of the cover 82 of the first accommodation portion 8. Facing surfaces of the respective first side guides 18 of the pair of side guides 17 become first side contact surfaces 18*a* contactable with an end in the axial direction (or an end of the core member Rc in the axial direction) of the roll body R accommodated in the first accommodation portion 8. By guiding the roll body R by the first side contact surface 18*a* of the pair of first side guides 18, a position of the roll body R in the first accommodation portion 8 in the left and right direction is determined.

The second side guide 19 includes a plate-shaped first portion 20 parallel to the side walls 12 and 13, and a second portion 21 parallel to the bottom wall 11. Facing surfaces of the first portions 20 of the respective second side guides 19 in the pair of side guides 17 become second side contact surfaces 20*a* contactable with an end of the paper P in the width direction. By guiding the paper P by the second side contact surfaces 20*a* of the pair of second side guides 19, a position of the paper P in the feed tray 1 in the left and right direction is determined.

The second portion 21 of the second side guide 19 extends from a lower end portion of the first portion 20 toward the right or left toward a side of the opposite second side guide 19. An upper surface of the second portion 21 of the pair of second side guides 19 becomes a lower contact surface 21*a* that contacts a lower surface of the paper P. The lower contact surface 21*a* is connected to the second side contact surface 20*a*.

Figure 6:
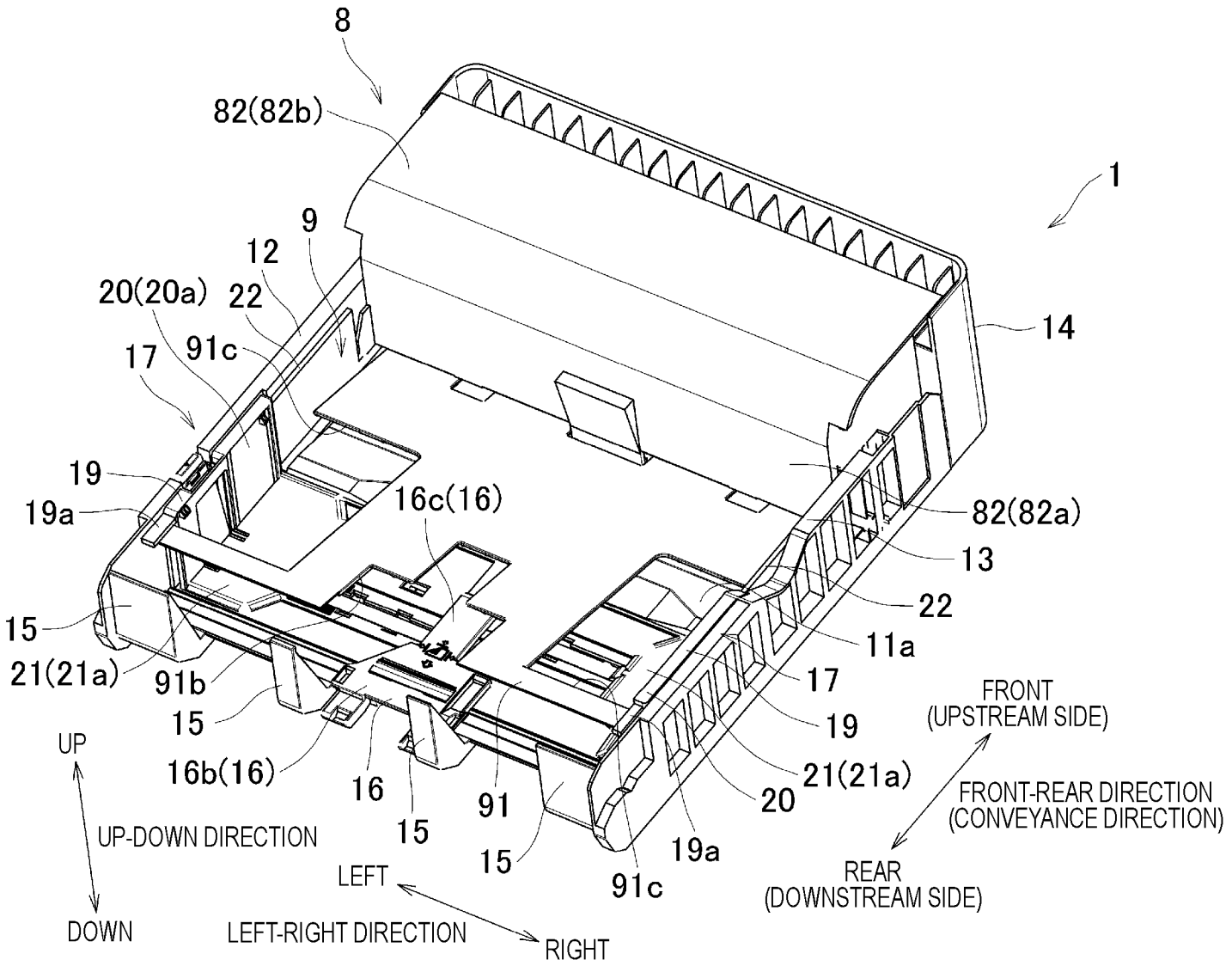
FIG. 6 is a diagram illustrating a state in which upward rotation of a support plate is regulated by a regulating portion.

A regulating portion 19*a* that regulates upward rotation of the support plate 91 is formed on an upper portion of an end portion on a downstream side of the second side guide 19 in the conveyance direction. The regulating portion 19*a* protrudes from the end portion on the downstream side of the second side guide 19 in the conveyance direction toward the downstream side in the conveyance direction. As illustrated in FIG. 6, when the support plate 91 rotates upward, both ends on a downstream side of the support plate 91 in the conveyance direction contact lower ends of the regulating portions 19*a* respectively formed on the pair of second side guides 19. A portion of the support plate 91 that contacts the lower end of the regulation portion 19*a* is a portion on a downstream side of a notch 91*c*, which will be described later, in the conveyance direction. Accordingly, the upward rotation of the support plate 91 is regulated.

The connecting portion 22 has a plate shape parallel to the side walls 12 and 13. The connecting portion 22 connects an end portion on a downstream side of the first side guide 18 in the conveyance direction and an end portion on an upstream side of the first portion 20 of second side guide 19 in the conveyance direction. A position of a lower end of the connecting portion 22 in the up and down direction is higher than a position of an upper surface of the support plate 91 in an inclined posture which will be described later. As illustrated in FIG. 5, a position of an upper end of the connecting portion 22 in the up and down direction in a portion where the rear portion 82*a* of the cover 82 is provided in the conveyance direction is lower than a position of a lower end of the rear portion 82*a* of the cover 82.

Figure 2:
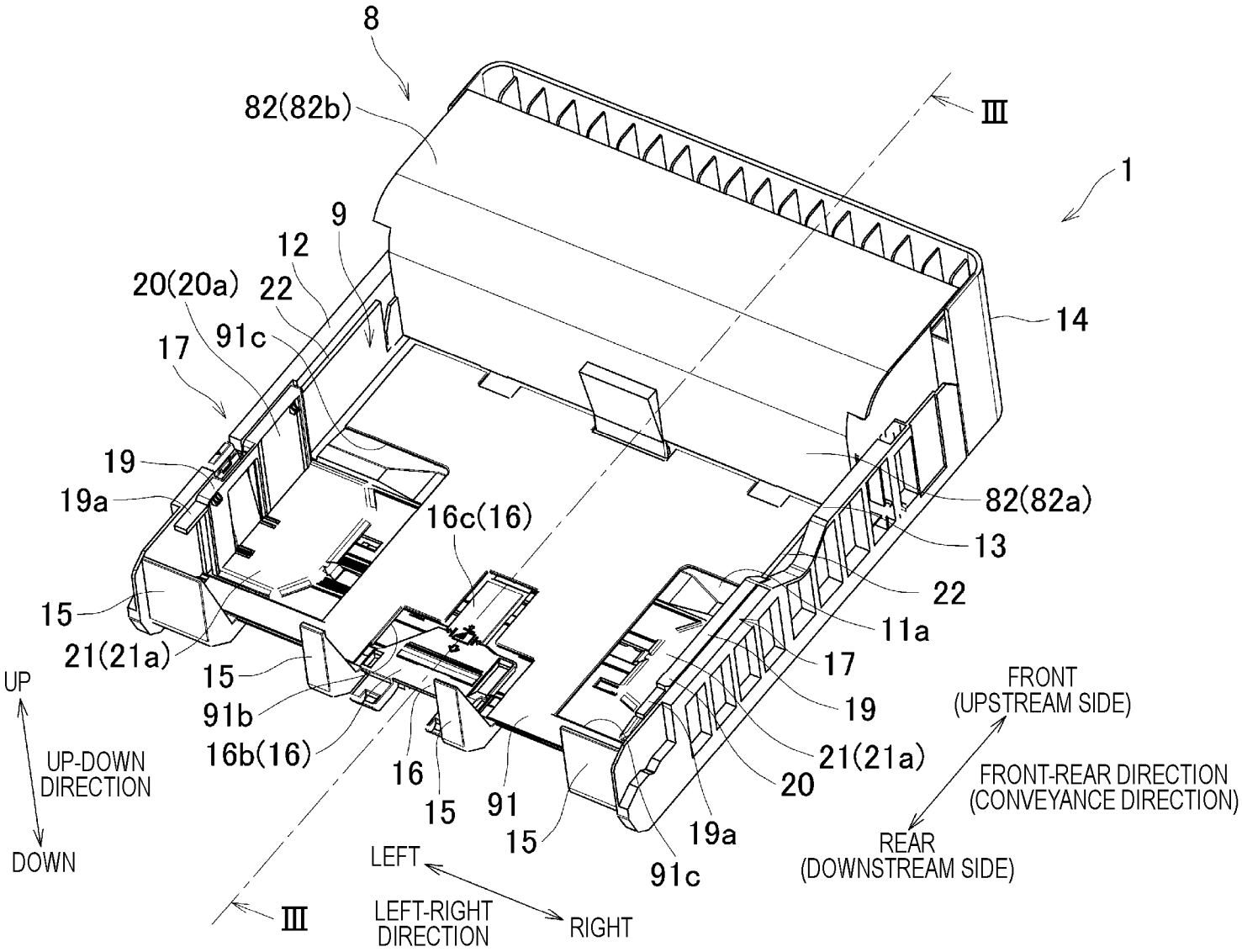
FIG. 2 is a perspective view of a feed tray illustrated in FIG. 1.

As illustrated in FIGS. 2 and 4, notches 91*b* and 91*c* are formed in the support plate 91. The notch 91*b* is formed at an end portion on the downstream side of the support plate 91 in the conveyance direction. When viewed from the top, the upper surface 16*a* of the convex portion 16 is located in the notch 91*b*.

The notches 91*c* are respectively formed at both end portions of the support plate 91 in the left and right direction. The first portion 20 of the second side guide 19 is located in the notch 91*c*. A lower end portion of the first portion 20 is located below the support plate 91, and an upper end portion of the first portion 20 is located above the support plate 91. That is, a pair of first portions 20 of the second side guide 19 is provided to be located on both sides of the support plate 91 in the left and right direction. The first portion 20 of the second side guide 19 moves in the left and right direction within a range of the notch 91*c*. As the first portion 20 of the second side guide 19 moves in the left and right direction, the first side guide 18 connected to the first portion 20 by the connecting portion 22 also moves in the left and right direction.

Here, a length in the left and right direction of a portion of the support plate 91 located between the pair of second side guides 19, that is, a portion of the support plate 91 in which the notches 91*c* are respectively formed at both end portions thereof in the left and right direction is defined as a width W. The width W is equal to or less than a minimum width of the roll paper Rp that can be used in the printer 100. Specifically, the minimum width of the roll paper Rp used in the printer 100 is 210 mm.

Figure 7A:
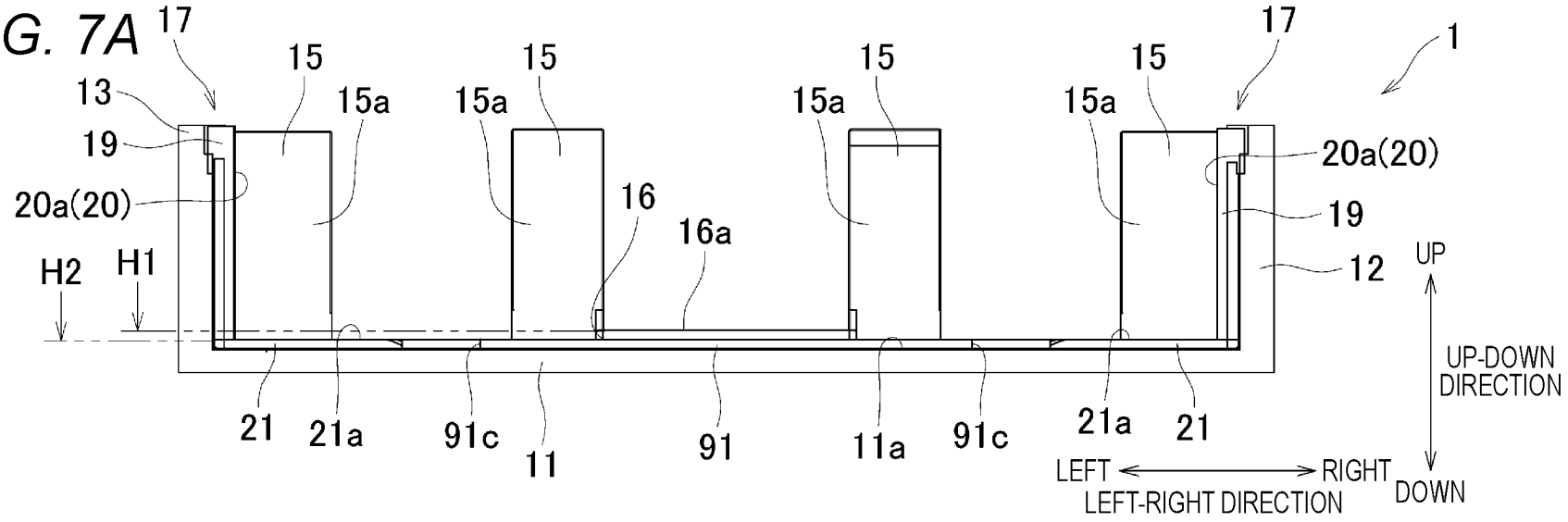
FIGS. 7A and 7B are cross-sectional views taken along a line VII-VII of the feed tray illustrated in FIG. 4.
Figure 7B:
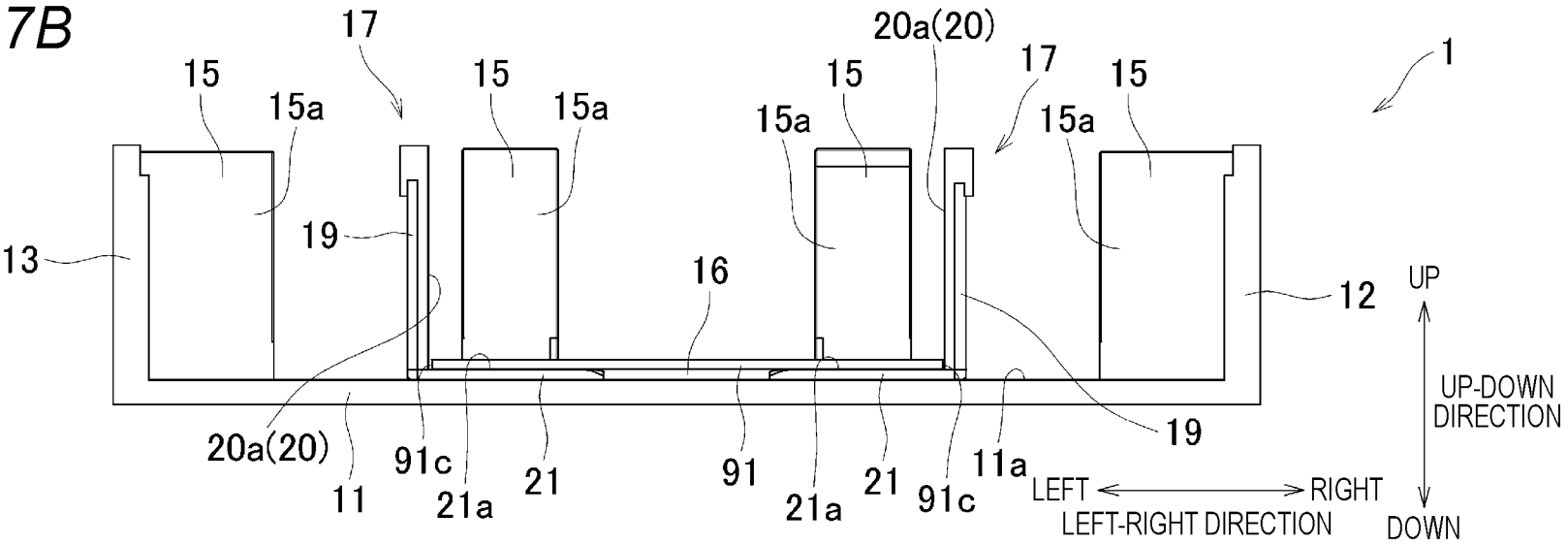
Figure 8:
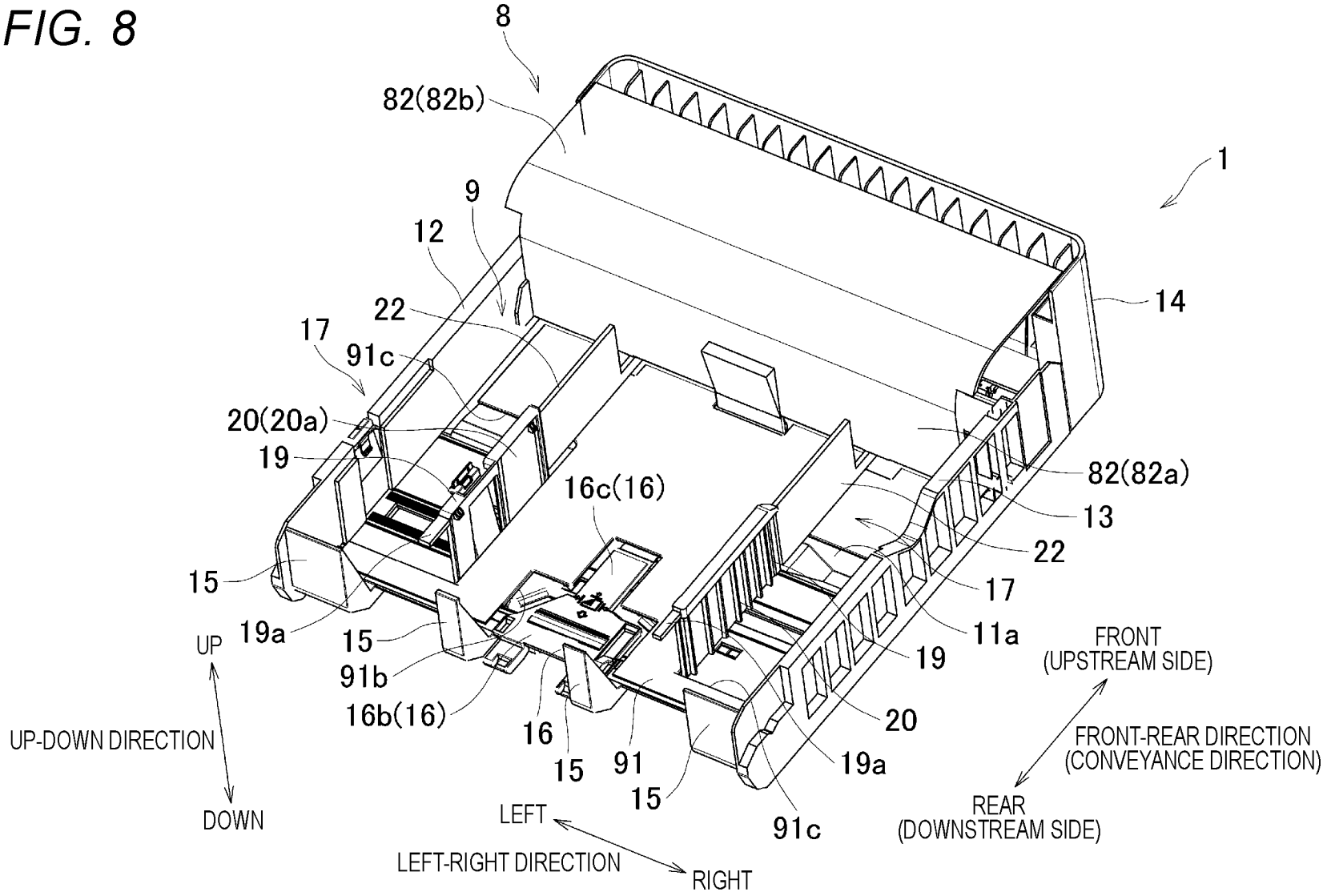
FIG. 8 is a diagram illustrating a state in which a second side guide is in an overlapping position.

In the state illustrated in FIGS. 2 and 7A, the pair of second side guides 19 is provided in a non-overlapping position where the lower contact surface 21*a* does not overlap with the support plate 91 when viewed from the top. The pair of second side guides 19 moves from a position illustrated in FIGS. 2 and 7A toward a center of the paper P in the left and right direction to approach each other, such that as illustrated in FIGS. 7B and 8, the pair of second side guides 19 moves to an overlapping position where the lower contact surface 21*a* overlaps with the support plate 91 when viewed from the top. In the illustrative embodiment, when guiding the cut paper Kp accommodated in the second accommodation portion 9, the second side guide 19 is located in the non-overlapping position.

As illustrated in FIG. 7A, when the roll paper Rp is not set in the feed tray 1 and the pair of second side guides 19 is in the non-overlapping position where the lower contact surface 21*a* thereof does not overlap with the support plate 91 when viewed from the top, a lower surface of the support plate 91 contacts the bottom surface 11*a* of the feed tray 1. Here, the support plate 91 becomes a posture in which a direction connecting a front end portion and a rear end portion almost coincides with the conveyance direction.

When the pair of second side guides 19 is in the non-overlapping position, a height position of the upper surface of the support plate 91 is substantially the same as a height position of the lower contact surface 21*a* of the second side guide 19. That is, when the pair of second side guides 19 is in the non-overlapping position, the upper surface of the support plate 91 and the lower contact surface 21*a* of the second side guide 19 are located substantially in the same plane. Here, a height position H1 of the upper surface 16*a* of the convex portion 16 is higher than a height position H2 of the upper surface of the support plate 91 and the lower contact surface 21*a* of the second side guide 19.

When the second side guide 19 moves from the position illustrated in FIG. 7A to the left and right direction, and moves to the overlapping position where the lower contact surface 21*a* overlaps with the support plate 91 when viewed from the top as illustrated in FIG. 7B, the support plate 91 is pushed by the second portion 21 of the second side guide 19 and rotates upward. That is, when the second side guide 19 is in the overlapping position, the lower contact surface 21*a* of the second side guide 19 is located below the support plate 91. When the roll paper Rp is not set in the feed tray 1 and the pair of second side guides 19 is in the overlapping position, the lower surface of the support plate 91 contacts the lower contact surface 21*a* of the second side guide 19. A posture of the support plate 91 here is defined as an inclined posture.

Here, an example of a procedure for setting the roll paper Rp in the feed tray 1 will be described. First, the feed tray 1 is pulled from the rear to the front and is pulled out from the housing 100*a*. Next, the cover 82 of the first accommodation portion 8 rotates to expose the accommodation space of the roll body R of the first accommodation portion 8, such that the support base 81 is caused to support the roll body R. Continuously, the positions of the pair of side guides 17 in the left and right direction are adjusted, and both ends of the roll body R in the axial direction contact the first side contact surface 18*a* of the first side guide 18. Accordingly, both ends of the roll body R supported by the support base 81 in the axial direction are guided by the first side guide 18, and the position of the roll body R in the left and right direction is determined.

Continuously, the roll body R is manually rotated to unroll the roll paper Rp from the roll body R, and a tip portion of the roll paper Rp is fed to the upper surface 16*a* of the base portion 16*b* of the convex portion 16 on the bottom surface 11*a*. The roll paper Rp unrolled from the roll body R is first fed from the front side of the support base 81 to the rear side of the support base 81 through the gap G below the support base 81. The roll paper Rp is fed into the introduction path defined by the bottom wall 11 of the feed tray 1 and the support plate 91 while moving the rotating shaft 91*a* of an end portion on an upstream side of the support plate 91 in the conveyance direction upward.

A lower surface of the roll paper Rp reaching a position where the side guide 17 is disposed in the introduction path I contacts the lower contact surface 21*a* of the second side guide 19. Both ends of the roll paper Rp in the width direction contact the second side contact surface 20*a* of the second side guide 19. Accordingly, both ends of the roll paper Rp fed into the introduction path in the width direction are guided by the second side guide 19, such that the position of the roll paper Rp in the left and right direction is determined. Next, the roll paper Rp is fed to the downstream side in the conveyance direction until the tip portion of the roll paper Rp reaches the upper surface 16*a* of the base portion 16*b* of the convex portion 16.

Next, an example of a procedure for feeding the roll paper Rp from the feed tray 1 will be described. First, after setting the roll paper Rp in the feed tray 1 according to the above-described procedure, the feed tray 1 is mounted on the housing 100*a* without accommodating the cut paper Kp in the second accommodation portion 9. By mounting the feed tray 1 on the housing 100*a*, the feed roller 2 contacts a portion of the roll paper Rp disposed on the upper surface 16*a* of the base portion 16*b* in the convex portion 16. After that, the feed roller 2 rotates by driving the feeding motor to apply a conveying force to the roll paper Rp, such that the roll paper Rp is fed from the feed tray 1.

When the image is not immediately formed on the roll paper Rp and when the image is formed on the cut paper Kp, the roll paper Rp is set, and then the feed tray 1 is mounted on the housing 100*a* in a state where the cut paper Kp is accommodated in the second accommodation portion 9. Here, when the image is formed on the roll paper Rp, the feed tray 1 is pulled out from the housing 100*a* again and the cut paper Kp is removed from the second accommodation portion 9, and then the feed tray 1 is mounted on the housing 100*a*.

Next, an example of a procedure for feeding the cut paper Kp from the feed tray 1 will be described. First, the feed tray 1 is pulled out from the housing 100*a*, and a plurality of sheets of cut paper Kp in the stacked state are placed on the upper surface of the support plate 91. Next, the positions of the pair of side guides 17 in the left and right direction are adjusted so that both ends of the cut paper Kp in the width direction contact the second side contact surface 20*a* of the second side guide 19. After that, the feed tray 1 is mounted on the housing 100*a*. By mounting the feed tray 1 on the housing 100*a*, the feed roller 2 contacts the cut paper Kp located at the uppermost position among the plurality of sheets of cut paper Kp in the stacked state. After that, the feed roller 2 rotates by driving the feeding motor to apply a conveying force to the cut paper Kp, such that the cut paper Kp is fed from the feed tray 1.

As described above, the feed mechanism 3 mounted on the printer 100 of the illustrative embodiment includes the feed tray 1 that is configured to accommodate the roll body R around which the long paper is rolled in the roll shape and is configured to be inserted into and removed from the housing 100*a* of the printer 100. The feed tray 1 includes: the first accommodation portion 8 configured to accommodate the roll body R; the pair of side walls 12 and 13 respectively provided on both sides of the first accommodation portion 8 in the axial direction of the roll body accommodated in the first accommodation portion 8; and the side guide 17 that is disposed inside the pair of side walls 12 and 13 and is contactable with the roll body R accommodated in the first accommodation portion 8 and the end of the roll paper Rp unrolled from the roll body R in the left and right direction.

According to the above-described configuration, the positions of the roll body R and the roll paper Rp in the left and right direction are determined by causing the ends thereof in the left and right direction to contact the side guide 17.

Therefore, it is possible to prevent position deviation of the roll body R and the roll paper Rp in the left and right direction.

In the feed mechanism 3 of the illustrative embodiment, the side guide 17 is movable in the left and right direction. Therefore, the side guide 17 is movable according to a width of the roll body R (the roll paper Rp), such that the positions of the roll body R and the roll paper Rp in the left and right direction can be more accurately determined. Even when the roll body R (the roll paper Rp) having various widths is used in the printer 100, it is possible to determine the positions of the roll body R and the roll paper Rp in the left and right direction.

The feed mechanism 3 of the illustrative embodiment includes the second accommodation portion 9 configured to accommodate the cut paper Kp in a posture in which the width direction thereof coincides with the left and right direction. The side guide 17 is also contactable with an end of the cut paper Kp accommodated in the second accommodation portion 9 in the left and right direction. Therefore, the positions of the roll paper Rp and the cut paper Kp in the left and right direction may be determined by the same side guide 17.

In the feed mechanism 3 of the illustrative embodiment, the second accommodation portion 9 includes the support plate 91 that supports a plurality of sheets of cut paper Kp placed in the stacked state from below. A pair of side guides 17 is provided to be located on both sides of the support plate 91 in the left and right direction, and includes the second side contact surface 20*a* that contacts the end of the paper P in the left and right direction and the lower contact surface 21*a* that is connected to the second side contact surface 20*a* and is in contact with the lower surface of the paper P. The roll paper Rp unrolled from the roll body R passes below the support plate 91. The side guide 17 moves toward the center in the left and right direction of the roll paper Rp with respect to the left and right direction, thereby making it possible to move from the non-overlapping position where the lower contact surface 21*a* does not overlap with the support plate 91 when viewed from the top to the overlapping position where the lower contact surface 21*a* is located below the support plate 91. Therefore, since the side guide 17 is movable toward the center of the paper P in the left and right direction and is movable to the overlapping position where the lower contact surface 21*a* is located below the support plate 91, it is also possible to handle the roll paper Rp having a relatively narrow width.

In the feed mechanism 3 of the illustrative embodiment, when the side guide 17 is in the non-overlapping position, the upper surface of the support plate 91 and the lower contact surface 21*a* of the side guide 17 are located substantially in the same plane. Therefore, when the side guide 17 is in the non-overlapping position, the upper surface of the support plate 91 that contacts the lower surface of the cut paper Kp and the lower contact surface 21*a* of the side guide 17 are in the same plane, such that the cut paper Kp may be stably supported.

In the feed mechanism 3 of the illustrative embodiment, the side guide 17 includes the regulating portion 19*a* that regulates the upward rotation of the support plate 91. When the support plate 91 is pushed upward by the roll paper Rp and rotates above the second side contact surface 20*a* of the side guide 17, the end of the roll paper Rp in the left and right direction is not able to contact the second side contact surface 20*a* of the side guide 17, such that the position of the roll paper Rp in the left and right direction may not be determined. In the illustrative embodiment, since the upward rotation of the support plate 91 is regulated by the regulating portion 19*a* formed on the side guide 17, the position of the roll paper Rp in the left and right direction can be reliably determined.

In the feed mechanism 3 of the illustrative embodiment, the width W of the portion of the support plate 91 located between the pair of second side guides 19 is equal to or less than the minimum width of the roll paper Rp used in the printer 100. Therefore, the side guide 17 surely guides the end of the roll paper Rp (the roll body R) in the left and right direction used in the printer 100, and the position of the roll paper Rp (the roll body R) can be determined.

The feed mechanism 3 of the illustrative embodiment includes: the feed roller 2 that feeds the cut paper Kp in contact with the cut paper Kp located at the uppermost position among the plurality of sheets of cut paper Kp placed on the support plate 91 in the stacked state; and the separation piece 31 that is located on the downstream side of the support plate 91 with respect to the conveyance direction of the cut paper Kp by the feed roller 2 and separates the cut paper Kp that contacts the feed roller 2 from the rest of cut paper Kp by contacting the central portion of the cut paper Kp in the width direction. The feed tray 1 is provided on the bottom surface 11*a* of the feed tray 1, which is a conveying surface of the roll paper Rp, and includes the convex portion 16 protruding upward. The notch 91*b* is formed in the central portion in the left and right direction at the end portion on the downstream of the support plate 91 in the conveyance direction, and the convex portion 16 is located in the notch 91*b*. The height position H1 of the upper surface 16*a* of the convex portion 16 is higher than the height position H2 of the upper surface of the support plate 91 and the lower contact surface 21*a* of the second side guide 19. Therefore, the end portion of the cut paper Kp placed on the support plate 91 on the downstream side in the conveyance direction becomes a convex shape in which the central portion in the left and right direction is lifted upward by the convex portion 16 and protrudes upward. Accordingly, the cut paper Kp fed from the feed tray 1 is caused to contact the separation piece 31 at a desired angle, thereby making it possible to appropriately separate the cut paper Kp.

The feed mechanism 3 of the illustrative embodiment includes: the first side guide 18 including the first side contact surface 18*a* contactable with the end of the roll body R accommodated in the first accommodation portion 8 in the left and right direction; and the second side guide 19 including the second side contact surface 20*a* contactable with the roll paper Rp unrolled from the roll body R. The first side guide 18 and the second side guide 19 are interlocked with each other when moving in the left and right direction. Therefore, it is possible to prevent the first side contact surface 18*a* of the first side guide 18 and the second side contact surface 20*a* of the second side guide 19 from positionally deviating, thereby making it possible to prevent the roll paper Rp from being affected by a conveyance load and prevent the roll paper Rp from skewing.

Illustrative embodiments of the present disclosure have been described above with reference to the drawings, and it should be considered that a specific configuration is not limited to the illustrative embodiments. The scope of the present invention is indicated not by the description of the illustrative embodiments but by the scope of the present disclosure, and includes all modifications within the meaning equivalent to the scope of the present disclosure.

The illustrative embodiment describes a case in which the support plate 91 is rotatable up and down around the rotating shaft 91*a* extending along the left and right direction, and the support plate 91 may not be configured to be rotatable. However, from a viewpoint of eliminating jamming when the roll paper Rp is jammed below the support plate 91, the support plate 91 may be configured to be removable from the feed tray 1.

The illustrative embodiment describes a case in which the side guide 17 is movable in the left and right direction, and the position of the side guide 17 in the left and right direction may be fixed.

The illustrative embodiment describes a case in which the side guide 17 is contactable with the roll body R accommodated in the first accommodation portion 8 and the end of the roll paper Rp unrolled from the roll body R in the left and right direction, and the end of the cut paper Kp accommodated in the second accommodation portion 9 in the left and right direction, but is not limited thereto. The side guide 17 may be able to contact at least one of the roll body R accommodated in the first accommodation portion 8 and the end of the roll paper Rp unrolled from the roll body R in the left and right direction.

The illustrative embodiment describes a case in which the second side guide 19 is movable from the non-overlapping position where the lower contact surface 21*a* does not overlap with the support plate 91 when viewed from the top to the overlapping position where the lower contact surface 21*a* is located below the support plate 91, but is not limited thereto. The second side guide 19 may be configured not to be able to move to the overlapping position where the lower contact surface 21*a* is located below the support plate 91.

Figure 9A:
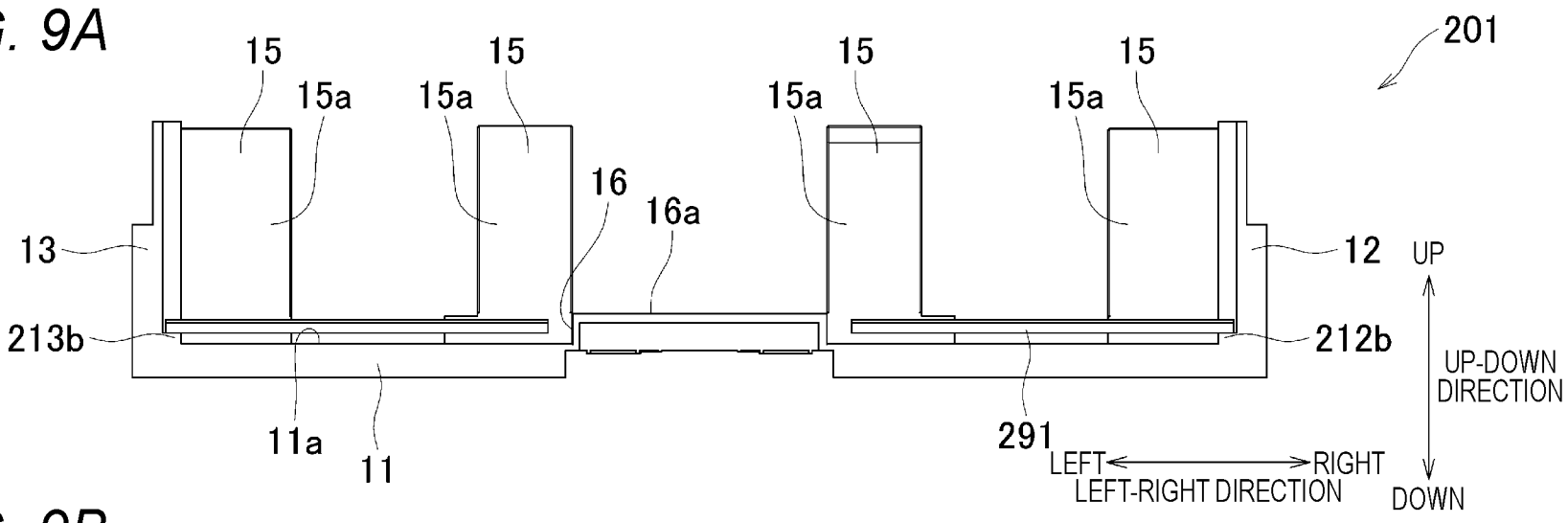
FIGS. 9A and 9B are cross-sectional views of a feed tray according to a first modification, FIG. 9A corresponds to a cross-sectional view taken along a line IXA-IXA of the feed tray illustrated in FIG. 4, and FIG. 9B corresponds to a cross-sectional view taken along a line VII-VII of the feed tray illustrated in FIG. 4.
Figure 9B:
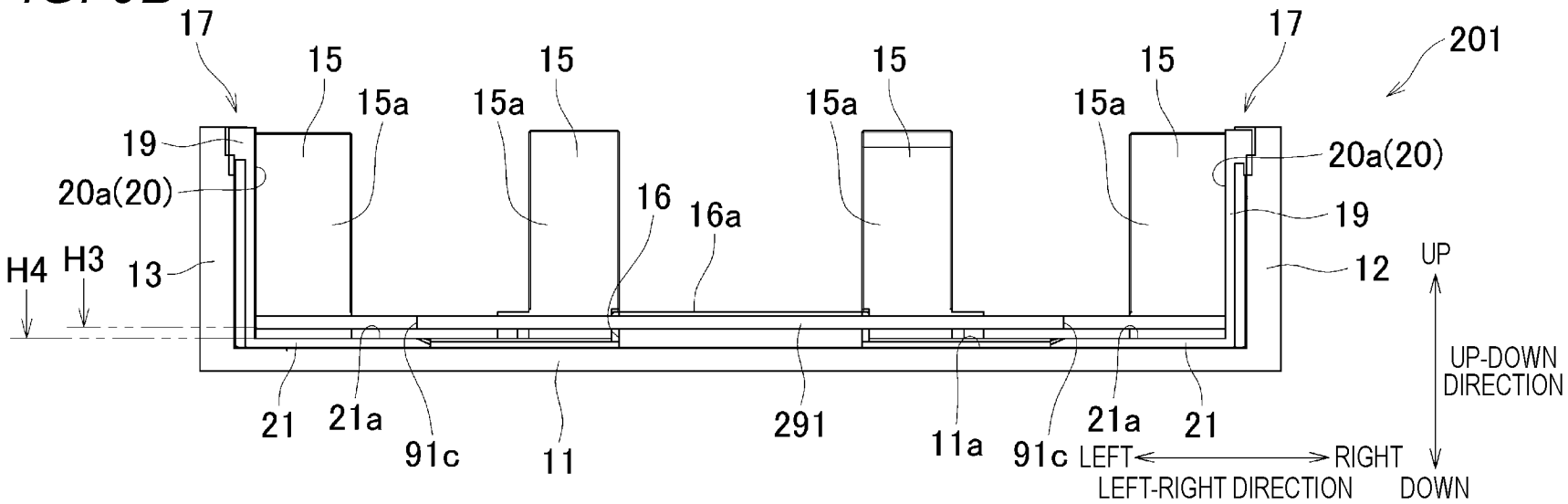

In a feed tray 201 according to a first modification of the illustrative embodiment illustrated in FIG. 9, regulating portions 212*b* and 213*b* that regulate downward rotation of a support plate 291 are respectively formed on the side walls 12 and 13. The regulating portion 212*b* protrudes from the lower end portion of the side wall 12 toward the side wall 13. The regulating portion 213*b* protrudes from the lower end portion of the side wall 13 toward the side wall 12. The downward rotation of the support plate 291 is regulated by causing both end portions of the support plate 291 in the left and right direction to contact the upper surfaces of the regulating portions 212*b* and 213*b*. In the modification, since the downward rotation of the support plate 291 is regulated by the regulating portions 212*b* and 213*b*, the bottom surface 11*a* of the feed tray 201 and the support plate 291 are separated from each other, such that a space is secured between the bottom surface 11*a* and the support plate 291.

In the feed tray 201, when the support plate 291 is in a regulated state in which the downward rotation thereof is regulated by the regulating portions 212*b* and 213*b*, the support plate 291 becomes a posture in which a direction connecting the front end portion and the rear end portion almost coincides with the conveyance direction. A height position H3 of a lower surface of the support plate 291 in the regulated state is higher than a height position H4 of the lower contact surface 21*a* of the second side guide 19. Therefore, the second side guide 19 does not contact the support plate 291 even when the second side guide 19 is in an overlapping position where the lower contact surface 21*a* overlaps with the support plate 291 when viewed from the top.

In the feed tray 201, the space is secured between the bottom surface 11*a* and the support plate 291. Therefore, it is possible to prevent conveyance resistance occurring when the roll paper Rp passing between the bottom surface 11*a* and the support plate 291 rubs against the bottom wall 11 and the support plate 291. When the second side guide 19 is in the overlapping position, a space is secured between the lower contact surface 21*a* of the second side guide 19 and the support plate 291. Therefore, it is possible to prevent conveyance resistance occurring when the roll paper Rp passing between the lower contact surface 21*a* and the support plate 291 rubs against the lower contact surface 21*a* and the support plate 291. In the feed tray 201, even when the second side guide 19 is in the overlapping position, the support plate 291 is in the posture in which the direction connecting the front end portion and the rear end portion almost coincides with the conveyance direction without rotating upward. Accordingly, the cut paper Kp can be normally fed even when the second side guide 19 is in the overlapping position, such that it is possible to cope with the cut paper Kp having a relatively narrow width.

In the feed mechanism 3, the illustrative embodiment describes a case in which the second side guide 19 is formed with the regulating portion 19*a* that protrudes from the end portion on the downstream in the conveyance direction toward the downstream side in the conveyance direction and that regulates the upward rotation of the support plate 91, and when the support plate 91 rotates upward, the portion of the support plate 91 on the downstream side of the notch 91*c* in the conveyance direction contacts the lower end of the regulating portion 19*a*, but is not limited thereto. That is, for example, the regulating portion 19*a* may not be formed, and the upward rotation of the support plate 91 may be configured not to be regulated.

Figure 10:
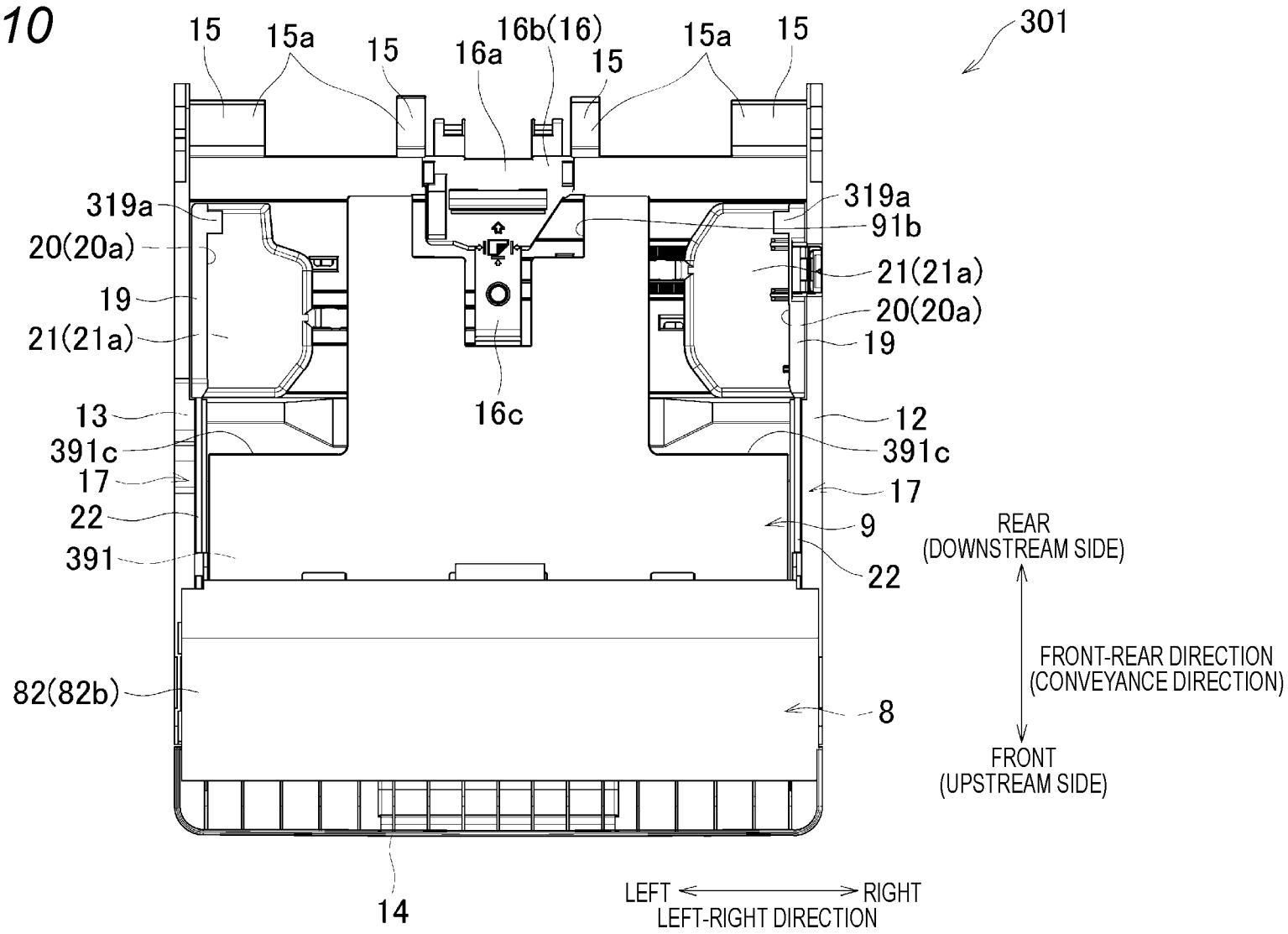
FIG. 10 is a top view of a feed tray according to a second modification.

For example, in a feed tray 301 according to a second modification of the illustrative embodiment illustrated in FIG. 10, the second side guide 19 is formed with a regulating portion 319*a* that protrudes from the upper end portion on the downstream side of the second side portion contact surface 20*a* in the conveyance direction toward the facing second side contact surface 20*a*. In the feed tray 301, notches 391*c* respectively formed at both ends of the support plate 391 in the left and right direction are opened to the downstream side in the conveyance direction. In the feed tray 301, when the support plate 391 rotates upward in a state where the entire lower contact surface 21*a* of the second side guide 19 is located below the support plate 391, a portion of the support plate 391 located between the pair of second side guides 19 contacts a lower end of the regulating portion 319*a*. Accordingly, upward rotation of the support plate 391 is regulated.

The illustrative embodiment describes a case in which the width W of the portion of the support plate 91 located between the second side contact surfaces 20*a* of the pair of second side guides 19 is equal to or less than the minimum width of the roll paper Rp used in the printer 100, but is not limited thereto. The width W may be larger than the minimum width of the roll paper Rp used in the printer 100.

The illustrative embodiment describes a case in which the height position H1 of the upper surface 16*a* of the convex portion 16 formed on the bottom surface 11*a* of the feed tray 1 is higher than the height position H2 of the upper surface of the support plate 91 and the lower contact surface 21*a* of the second side guide 19, and the height position H1 may be equal to or lower than the height position H2.

The illustrative embodiment describes a case in which the first side guide 18 and the second side guide 19 are formed to be integrated with each other, and are interlocked with each other when moving in the left and right direction, but is not limited thereto. The first side guide 18 and the second side guide 19 may be configured to be provided separately, and the first side guide 18 and the second side guide 19 may be configured to be interlocked with each other by an interlocking mechanism. The first side guide 18 and the second side guide 19 may be configured not to be interlocked with each other.

The illustrative embodiment describes a case in which the first accommodation portion 8 includes the support base 81 that supports the roll body R, but is not limited thereto. The first accommodation portion 8 may include a support portion that rotatably supports the core member Rc.

The present invention may be applied to all image forming apparatuses including a feed mechanism including a feed tray configured to accommodate at least a roll medium. That is, for example, the present invention may be applied not only to an inkjet printer, but also to a laser type printer in which an electrostatic latent image is formed by exposing a photoreceptor with a laser and an LED type electrophotographic printer in which an electrostatic latent image is formed by exposing a photoreceptor with an LED (abbreviation of Light Emitting Diode). A sheet-like medium is not limited to paper, and may be cloth or the like as long as the sheet-like medium is in a form of a sheet.

What is claimed is:

1. A feed tray comprising:

a first accommodation portion configured to accommodate a roll body from which a first sheet-shaped medium is to be unrolled;

a side guide movable in an axial direction of the roll body accommodated in the first accommodation portion; and a second accommodation portion configured to accommodate a second sheet-shaped medium in a stackable manner, wherein the side guide is contactable with an end of the first sheet-shaped medium unrolled from the roll body in the axial direction, wherein the second accommodation portion comprises a support member configured to support the second sheet-shaped medium from below, wherein the side guide comprises a first side guide located on one side of the support member in the axial direction and a second side guide located on another side of the support member in the axial direction, the side guide comprises:

a first side contact surface contactable with the end of the first sheet-shaped medium unrolled from the roll body;

a second side contact surface contactable with the end of the second sheet-shaped medium in the axial direction; and a lower contact surface that is connected to the first and second side contact surfaces and is contactable with a lower surface of the first sheet-shaped medium and a lower surface of the second sheet-shaped medium, wherein the first sheet-shaped medium is to be unrolled from the roll body below the support member, and wherein the side guide is movable from a first position to a second position, the lower contact surface not overlapping with the support member when viewed from a top in a case the side guide is located in the first position, at least a part of the lower contact surface being located below the support member in a case the side guide is located in the second position.

2. The feed tray according to claim 1, wherein a height position of a lower surface of the support member is higher than a height position of the lower contact surface of the side guide.

3. The feed tray according to claim 1, wherein the support member is rotatable up and down around a rotating shaft that is parallel to the axial direction.

4. The feed tray according to claim 1, wherein the support member is rotatable up and down around a rotating shaft that is parallel to the axial direction, the support member rotating upward by being pushed by the side guide in a case the side guide is located in the second position.

5. The feed tray according to claim 4, wherein in a case the side guide is in the first position, an upper surface of the support member and the lower contact surface of the side guide are located in the same plane.

6. The feed tray according to claim 3, wherein the side guide comprises a regulating portion configured to regulate upward rotation of the support member.

7. The feed tray according to claim 1, wherein a width of a portion of the support member located between the first and second side guides in the axial direction is equal to or less than a width of the first sheet-shaped medium.

8. The feed tray according to claim 7, wherein the width of the portion of the support member located between first and second side guides in the axial direction is 210 mm or less.

9. The feed tray according to claim 1, wherein the side guide is contactable with at least one end of the roll body accommodated in the first accommodation portion in the axial direction.

10. An image forming apparatus comprising:

a housing; and the feed tray according to claim 1, the feed tray being insertable into and removable from the housing.

11. An image forming apparatus comprising:

a housing; and a feed tray insertable into and removable from the housing, the feed tray further comprising:

a first accommodation portion configured to accommodate a roll body from which a first sheet-shaped medium is to be unrolled;

a side guide movable in an axial direction of the roll body accommodated in the first accommodation portion;

a second accommodation portion configured to accommodate a second sheet-shaped medium in a stackable manner and including a support member configured to support the second sheet-shaped medium from below; and a convex portion protruding upward, the convex portion being provided on a conveying surface on which the first sheet-shaped medium unrolled from the roll body is conveyed, and wherein the image forming apparatus further comprises:

a feed roller configured to feed the second sheet-shaped medium by contacting the second sheet-shaped medium located at the uppermost position among a plurality of the second sheet-shaped medium on the support member in the second accommodation portion; and a separation piece located on a downstream side of the support member with respect to a conveyance direction of the second sheet-shaped medium by the feed roller, the separation piece being configured to separate the second sheet-shaped medium that contacts the feed roller from the rest of the plurality of the second sheet-shaped medium by contacting a central portion of the second sheet-shaped medium in the axial direction, wherein a notch is formed in a central portion in the axial direction of a first end portion of the support member, the first end portion being an end portion on the downstream side of the support member in the conveyance direction, wherein the convex portion is located in the notch of the support member when viewed from the top, and wherein a height position of an upper surface of the convex portion is higher than a height position of the upper surface of the support member and a height position of a lower contact surface of the side guide.

* * * * *